US012480727B1

(12) United States Patent
Sullivan et al.

(10) Patent No.: US 12,480,727 B1
(45) Date of Patent: Nov. 25, 2025

(54) EJECTOR KITS, ASSEMBLIES, AND METHODS OF USE

(71) Applicant: Weapons Armorer, Inc., Nixa, MO (US)

(72) Inventors: Gregory Michael Sullivan, Nixa, MO (US); John Randall Okubo, Brooklyn Park, MN (US)

(73) Assignee: Weapons Armorer, Inc., Nixa, MO (US)

( * ) Notice: Subject to any disclaimer, the term of this patent is extended or adjusted under 35 U.S.C. 154(b) by 0 days.

(21) Appl. No.: 18/767,703

(22) Filed: Jul. 9, 2024

(51) Int. Cl.
*F41A 15/16* (2006.01)

(52) U.S. Cl.
CPC ..... *F41A 15/16* (2013.01)

(58) Field of Classification Search
CPC ..... F41A 15/12; F41A 15/14; F41A 15/16
See application file for complete search history.

(56) References Cited

U.S. PATENT DOCUMENTS 1,108,356 A * 8/1914 Frommer ..... F41A 15/14 42/25
1,169,248 A * 1/1916 Frommer ..... F41A 15/16 42/25
1,352,515 A * 9/1920 Hulse ..... F41A 15/14 42/25
1,502,676 A * 7/1924 Kewish ..... F41A 5/24 89/159
1,578,777 A * 3/1926 Swebilius ..... F41A 15/16 42/25
1,907,164 A 5/1933 White
2,104,581 A * 1/1938 Browning ..... F41A 15/16 30/32
2,347,559 A * 4/1944 Percy ..... F41A 15/16 42/25
2,780,881 A * 2/1957 Crittendon ..... F41A 15/16 42/25
2,869,268 A 1/1959 Sefried et al.
2,873,546 A * 2/1959 Allyn ..... F41A 15/12 42/25
3,431,669 A * 3/1969 Morrow ..... F41A 15/16 42/25
3,619,928 A * 11/1971 Martin et al. ..... F41A 15/16 42/16

(Continued)

FOREIGN PATENT DOCUMENTS

FR 438753 A * 5/1912
GB 190009070 A 9/1900

(Continued)

OTHER PUBLICATIONS

Slow Motion Cycling of Remington 870 with modified Ejector and Ejector Spring, Aug. 18, 2017, 2 pages.

*Primary Examiner* — Gabriel J. Klein
(74) *Attorney, Agent, or Firm* — Kagan Binder, PLLC

(57) ABSTRACT

Kits for replacing the ejector of a shotgun include an ejector spring and a base member, where the base member is designed and adapted to be affixed to the interior surface of the receiver of the shotgun, and further to engage the ejector spring in a cantilevered tongue-and-groove (TAG) configuration. TAG ejector kits, TAG ejector assemblies, and TAG ejectors are suitably configured for operation in conjunction with pump action shotguns.

11 Claims, 12 Drawing Sheets

(56) References Cited

U.S. PATENT DOCUMENTS

| | | | | | |
|---|---|---|---|---|---|
| 4,163,334 | A * | 8/1979 | Tollinger | ..... | F41A 15/14 42/25 |
| 4,980,985 | A | 1/1991 | Dumortier | | |
| 2023/0213296 | A1 * | 7/2023 | Underwood | ..... | F41A 15/16 42/25 |

FOREIGN PATENT DOCUMENTS

| | | | | | |
|---|---|---|---|---|---|
| GB | 191200575 | A * | 7/1912 | | |
| GB | 413916 | A * | 7/1934 | | |
| RU | 2174663 | C1 * | 10/2001 | ..... | F41A 15/16 |

* cited by examiner

PRIOR ART
(KIT)

PRIOR ART
(ASSEMBLY)

PRIOR ART
ASSEMBLY - MOUNTED (INTERIOR)

PRIOR ART
ASSEMBLY - MOUNTED (EXTERIOR)

PRIOR ART
ASSEMBLY - MOUNTED (CUTAWAY)

EJECTOR KITS, ASSEMBLIES, AND METHODS OF USE

BACKGROUND

Disclosures herein relate to ejector means for firearms. More particularly, the disclosures herein relate to spring-type ejectors for pump action shotguns.

The REMINGTON® MODEL 870® pump action shotgun ("MODEL 870®") has been manufactured since 1950. The introduction of the MODEL 870® marked a major advance in reliability and performance of pump shotguns. The MODEL 870® is also relatively easy to disassemble and maintain. Accordingly the MODEL 870® has enjoyed decades of major commercial success in the United Stated and across the globe, with more than 10 million of these weapons produced as of 2009.

A plurality of known variations of the MODEL 870® exist in 12, 16, 20, 28 gauges as well as .410 bore, all of which are built on the same platform and receiver. Dozens of these variations are or were manufactured for civilian, law enforcement, and military use. All MODEL 870® shotguns feature a bottom-loading, side ejecting receiver and a tubular magazine under the barrel. They have dual action bars, internal hammer, and a bolt which locks into an extension in the barrel. Additionally, all MODEL 870® shotguns include an ejector affixed to the receiver for ejecting a spent (used or empty) shotgun shell by action of the bolt which is retracted by the user by actuating the action bar after firing the shotgun. This characteristic "pump action" design is the same for all MODEL 870® variations, and has been used since the firearm was introduced.

In some configurations, the MODEL 870® ejector includes a spring and a base for affixing and holding the spring in place. The ejector is mounted to the receiver of the MODEL 870® using rivets. When the MODEL 870® ejector is operably mounted within the MODEL 870® receiver, the base is disposed between the spring and the receiver for maintaining the spring in secured position. That is, the spring and base are affixed to the receiver in a stacked arrangement. The base is riveted (or staked) through the receiver, and the spring is riveted (or staked) through the base and also through the receiver. Accordingly, the receiver of the MODEL 870® defines two holes therethrough, adapted and located for affixing the ejector thereto using two rivets.

Due to the pump action of the ejector mechanism, the foregoing ejector design can be vulnerable to breakage. Repeated use and/or misalignment of the spring can cause warping or breaking of the spring over time. Further, misalignment of the base relative to the barrel can lead to catastrophic failure by breakage of the base when the user attempts to eject a spent shell, rendering the weapon inoperable. Accordingly, it is understood in the industry that the MODEL 870® ejector represents a point of design weakness in an otherwise robust weapon with a long history of reliability.

Further, since the MODEL 870® ejector is affixed by rivets through the receiver, it is difficult or even impracticable to attempt a repair in the field. To repair or replace a conventional MODEL 870® ejector, one or two rivets must be cut off, and replaced with new rivet(s) to stake the new ejector mechanism to the interior surface of the MODEL 870® receiver.

Repair of an inoperable MODEL 870® ejector is possible using suitable replacement parts and specialized tools. Replacement MODEL 870® ejector parts are available for purchase from companies such as BROWNELLS® Inc. of Grinnell, IA. The replacement parts are modeled on the original MODEL 870® ejector, and generally are sold as a kit including a spring, a base, and two rivets. The rivets are used to affix the base and spring to the receiver in the same stacked configuration as the original ejector, that is, with the base disposed between the receiver and the spring.

The components of a conventional MODEL 870® ejector replacement kit are shown in FIG. 1, labelled PRIOR ART (KIT). FIG. 1 shows that the kit includes a base, a spring, and two rivets. FIG. 2, labelled PRIOR ART (ASSEMBLY), shows the assembled components of the PRIOR ART (KIT), demonstrating that rivet 1 fastens the spring to the base (rivet 2 is not shown in FIG. 2) and further showing the stacked arrangement with the spring disposed on top of the base, such that the spring itself does not contact the receiver of the MODEL 870® when mounted therein.

As shown in FIG. 2, when the PRIOR ART ejector is assembled, rivet 1 secures the spring to the base. FIG. 3 shows the PRIOR ART ejector assembly mounted (affixed or secured) to the interior of the receiver of a MODEL 870®. As shown in FIG. 3, the spring is affixed on top of the base, and does not contact the receiver interior surface. FIG. 4 shows the PRIOR ART ejector assembly affixed as in FIG. 3, as viewed from the receiver exterior when the assembly of FIG. 3 is rotated 180° out of the plane of the page. As shown in FIG. 4, rivet 1 and rivet 2 extend through the receiver of the MODEL 870® and thus are visible on the exterior of the receiver.

FIG. 5 is a schematic representation of a cutaway view of a section of the PRIOR ART ejector affixed to the interior surface of a MODEL 870® receiver, taken through line P-P' in in FIG. 3. As shown in FIG. 5, rivet 1 extends through the receiver, the base, and the spring. That is, the spring is staked (riveted) to the receiver of the firearm through the base. As further shown in FIG. 5, when the PRIOR ART ejector is affixed, The PRIOR ART ejector excludes contact between the receiver and the spring when operably affixed to the interior surface of a MODEL 870® receiver.

Repair or replacement of the MODEL 870® ejector is possible using conventional aftermarket replacement parts such as the components of the PRIOR ART kit shown in FIG. 1. However, the repair/replacement process using conventional replacement parts is difficult. To access an inoperable ejector, the weapon must be cleared and the barrel, bolt and slide assembly removed to access the interior portion of the receiver where the ejector is affixed. One or both existing rivets must be broken to free the inoperable ejector (or in some cases just the spring) from the receiver. A special rivet cutter sized for the ejector rivet head is sold for this specific use.

The replacement part(s) are then riveted through the receiver, using the existing holes in the receiver where the previous rivets were affixed, and obtaining a configuration similar or identical to the manufacturer's original configuration of the MODEL 870® ejector. The repair requires a special staking tool to position the replacement base during the riveting, which is also sold for this specific use. The new rivets must be placed to ensure proper alignment of the ejector within the receiver and with respect to the barrel of the firearm.

Further, the replacement ejector is easily misaligned with the barrel, and/or the receiver becomes damaged by an individual attempting the foregoing repair. Even where the initial repair appears adequate, improper alignment of the replacement base with the barrel is common and often results in breakage of the replacement base during subsequent use. In such cases it is often necessary to engage the services of one of special skill in the art of firearm repair to complete or re-do the repair in order to render the firearm operable and safe.

The firearms industry has recognized the foregoing difficulties. A plethora of videos available on public fora such as YOUTUBE® offer testimonials to the relatively frequent need to replace the MODEL 870® ejector compared to other components of the MODEL 870®, the difficulty of the repair, negative outcomes of attempting the repair, and even significant difficulties with breakage of the specialized tools needed to complete the repair.

Nonetheless, the industry has failed to address these difficulties. Accordingly, the need persists for an improved ejector design for the REMINGTON® MODEL 870® that is less vulnerable to damage and wear, thereby reducing the need for future repair. The need persists for an improved repair/replacement process for the REMINGTON® MODEL 870® ejector that can be carried out without specialized tools. The need persists for an improved repair/replacement process for REMINGTON® MODEL 870® ejectors, wherein a repair or replacement could potentially be carried out in the field. Finally, the need persists for an improved replacement ejector for the REMINGTON® MODEL 870® that can be affixed to the MODEL 870® receiver using the pre-existing MODEL 870® receiver configuration, that is, without further modifying the receiver or any other aspect of the firearm's design.

SUMMARY

To address the foregoing needs, tongue-and-groove (TAG) ejector assemblies, TAG ejector kits, and TAG ejectors are described herein. The TAG ejector assemblies and TAG ejector kits are suitable for use in REMINGTON® MODEL 870® shotguns. The TAG ejector assemblies and TAG ejector kits may be suitably configured and adapted for use in 12, 16, 20, and 28 gauge as well as .410 bore MODEL 870® shotguns. Further, the TAG ejector assemblies and TAG ejector kits disclosed herein may be suitably configured for any automatic or pump action type shotgun wherein a spring type ejector is operably situated within the receiver of the shotgun.

In embodiments, a tongue-and-groove (TAG) ejector kit comprises, consists essentially of, or consists of a TAG base, a TAG spring, and first and second TAG fasteners. The TAG base is designed and adapted to be affixed to the interior surface of the receiver of a REMINGTON® MODEL 870® shotgun by engaging the first and second TAG fasteners, and further is designed and adapted to securely engage the TAG spring in a tongue-and-groove (TAG) configuration when the TAG ejector assembly is affixed to the interior surface of the MODEL 870® receiver. In embodiments, the first and second TAG fasteners are first and second TAG screws, and the TAG ejector assembly is affixed to the interior surface of the of a MODEL 870® receiver by engaging the TAG spring with the TAG base to form a TAG assembly, and affixing the TAG assembly to the MODEL 870® receiver interior surface by applying the first and second TAG screws through the receiver holes adapted for the MODEL 870® riveted ejector; and engaging the threaded portions of the first and second TAG screws with first and second mated threaded holes defined through the TAG base.

The TAG base includes a spring engagement area defined therein for engaging the TAG spring. The spring engagement area of the TAG base includes a tongue engagement hole defined therethrough, and a tongue engagement recess located proximal to and contiguous to the tongue engagement hole. In embodiments, the TAG spring is characterized as defining no holes therethrough; that, in embodiments, the TAG spring is a monolithic article that excludes holes defined therethrough. In embodiments, the TAG base is characterized as defining three holes therethrough: first and second mated threaded holes, and tongue engagement hole.

The TAG spring is adapted and configured to engage with the TAG base in the spring engagement area. The TAG spring includes a tongue portion having a shape and size that corresponds to the shape and size of the tongue engagement recess of the TAG base. The TAG spring is further adapted to extend through the tongue engagement hole of the TAG base, and engage the spring tongue portion with the tongue engagement recess. The tongue engagement recess and tongue engagement hole facilitate engagement of the tongue portion of the TAG spring within the TAG ejector.

Accordingly, in embodiments, a TAG ejector assembly comprises, consists essentially of, or consists of a TAG base having a TAG spring engaged therewith. The engaged TAG spring is extended through the tongue engagement hole defined within the TAG base, and a portion of the TAG spring tongue portion is disposed within the tongue engagement recess defined within the TAG base proximal to the tongue engagement hole. When the TAG ejector assembly is assembled in this configuration, the TAG spring tongue portion fits within the tongue engagement recess and extends through the tongue engagement hole. In embodiments, when the TAG base and the TAG spring are engaged, at least a portion of the TAG spring tongue portion completely fills, or substantially fills the TAG base tongue engagement recess.

The foregoing TAG ejector assembly obtains a TAG ejector configuration when the TAG ejector assembly is affixed to the MODEL 870® receiver by first and second TAG fasteners. Accordingly, described herein are methods of forming a TAG ejector assembly, and affixing the TAG ejector assembly to the receiver of a REMINGTON® MODEL 870® shotgun to form a TAG ejector. The methods comprise, consist essentially of, or consist of providing a TAG spring having a tongue portion, and a TAG base having a spring engagement area comprising a tongue engagement recess defined therein and a spring engagement hole defined proximal to the tongue engagement recess; extending the TAG spring through the spring engagement hole; engaging a portion of the TAG spring tongue portion within the tongue engagement recess to form a TAG ejector assembly; and affixing (or fastening) the TAG ejector assembly to the interior surface of a receiver of a REMINGTON MODEL 870® shotgun by riveting or screwing the TAG base to an interior surface of the MODEL 870® receiver. Stated differently, the methods comprise, consist essentially of, or consist of forming a TAG ejector assembly, and fastening the TAG ejector assembly to the interior of a MODEL 870® receiver to form a TAG ejector.

To facilitate fastening of the TAG ejector assembly, the TAG base defines first and second fastening holes therethrough, adapted and configured for disposing the first and second TAG fasteners therethrough. In embodiments, the circumference and spacing apart of the first and second fastening holes of the TAG base correspond to the circumference and spacing apart of first and second receiver holes defined through the MODEL 870® receiver by the manufacturer for the purpose of affixing a conventional MODEL 870® ejector to the receiver using rivets. Accordingly, in embodiments, the first and second TAG fasteners are adapted and configured to fasten, or affix, a TAG ejector assembly through the fastening holes of the TAG base and also through the receiver holes of the MODEL 870® receiver. In embodiments, the first and second TAG fasteners are configured to fasten, or affix, the TAG ejector to the interior of the receiver of a firearm through the TAG base; that is, the TAG ejector is not fastened to the receiver of a firearm through the TAG spring. Where first and second TAG fasteners are first and second screws, first and second fastening holes are first and second mated threaded holes.

Accordingly, in embodiments, the tongue-and-groove (TAG) configuration obtained by the TAG ejector obviates the need to stake, or affix, the TAG spring directly through or directly to the TAG base. In embodiments, the TAG ejector obviates the need to stake, or affix, the TAG spring through or directly to the receiver of a firearm. Instead, in embodiments, the TAG ejector is characterized as having only the TAG base portion of the TAG ejector affixed to the interior surface of the receiver of a firearm; further wherein the TAG spring is securely engaged and operably engaged within the TAG ejector. Accordingly, in embodiments, the TAG spring excludes any holes defined therethrough, since none are required to obtain an operable TAG ejector.

Further, in embodiments, the tongue-and-groove (TAG) configuration obtained by the TAG ejector obviates the need to stake, or affix, any part of the TAG ejector using rivets. Since only the TAG base portion of the TAG ejector is affixed to the interior surface of the receiver of a firearm, and the TAG spring is operably engaged within the TAG ejector and is not staked or affixed via a through hole, a TAG ejector assembly is suitably affixed to the interior surface of the receiver of a firearm using screws instead of rivets.

Accordingly, in embodiments, first and second TAG fasteners are first and second TAG screws, and the first and second fastening holes of the TAG base are first and second mated threaded holes, further wherein the first mated threaded hole is designed and adapted for mated disposition of the first TAG screw therein, and the second mated threaded hole is designed and adapted for mated disposition of the second TAG screw therein. In embodiments, the first and second fastening holes of the TAG base correspond to the circumference and spacing apart of the first and second MODEL 870® receiver holes, and a length of the TAG fasteners is further adapted to extend slidably through the receiver to engage with the TAG base fastening holes. In such embodiments, the first fastening hole of the TAG base is designed and adapted for mated disposition of the first TAG fastener therein, and the first TAG fastener is designed and adapted to be slidably disposed through a first receiver hole of a MODEL 870® receiver and engaged with the first TAG fastening hole; and the second fastening hole of the TAG base is designed and adapted for mated disposition of the second TAG fastener therein, and the second TAG fastener is designed and adapted to be slidably disposed through the second receiver hole of a MODEL 870® receiver and engaged with the second TAG fastening hole. In embodiments, the mated disposition is threaded mated disposition, and the first and second fasteners are screws.

In embodiments, fastening the TAG ejector assembly to the receiver of a MODEL 870® shotgun comprises, consists essentially of, or consists of affixing the TAG ejector assembly to the interior surface of a MODEL 870® receiver using first and second TAG fasteners, such that a portion of the TAG spring is disposed within the tongue engagement recess of the TAG base, and further contacts the receiver interior surface, and is further secured in place or substantially in place therein, that is, stationary or substantially stationary therein. Accordingly, the TAG spring of a TAG ejector is held in place or substantially in place, that is, stationary or substantially stationary, with respect to its position thereof relative to the receiver surface.

In embodiments, fastening a TAG ejector assembly to the interior surface of a MODEL 870® receiver results in a TAG ejector configuration, wherein the interior surface of the receiver becomes integral with the TAG ejector assembly, that is, wherein the TAG ejector assembly and the interior surface of the receiver are joined to form the TAG ejector. Accordingly, the MODEL 870® receiver surface, and the receiver itself, is an integral part of the TAG ejector. Accordingly, in embodiments, a TAG ejector comprises, consists essentially of, or consists of a TAG ejector assembly affixed to the interior surface of the receiver of a pump action firearm, such as the interior surface of a MODEL 870® receiver.

Accordingly, in embodiments, a TAG ejector comprises, consists essentially of, or consists of a TAG assembly affixed to the interior surface of the receiver of a REMINGTON® MODEL 870® shotgun. To form a TAG ejector, the TAG ejector assembly is contacted with the interior surface of the receiver and affixed thereto by staking the TAG base of the TAG assembly through with one or more rivets, one or more screws, or a combination thereof.

In embodiments of the TAG ejector, the tongue engagement recess of the TAG base is situated proximal to the receiver interior surface to define the "groove" of the TAG ejector; and the TAG spring tongue portion is disposed within the groove of the TAG ejector and is secured therein by the affixed (staked) contact of the TAG base with the receiver interior surface. Accordingly, TAG ejector obtains secure engagement of the tongue portion of the TAG spring within the groove between the TAG base and the MODEL 870® receiver. By "secure engagement" and similar terms it is meant that the tongue portion of a TAG spring is affixed, or held in place, and is substantially stationary within the groove of the TAG ejector. The TAG configuration obviates the need for staking the spring, and accordingly in embodiments a TAG spring includes no holes defined therethrough.

Accordingly, in embodiments, the affixing of the TAG ejector assembly to a MODEL 870® receiver is accomplished using screws. In embodiments, the affixing is accomplished using two screws. In embodiments, the TAG ejector is affixed only by two screws, and no other means of affixing or securing the TAG ejector are required or used. Accordingly, in embodiments, neither the TAG ejector kit, nor the TAG ejector includes rivets. Accordingly, in embodiments, the TAG ejector excludes rivets. In embodiments, the TAG ejector kit excludes rivets. In embodiments, operably affixing the TAG ejector assembly to the receiver of a MODEL 870® shotgun to provide a TAG ejector excludes the use of rivets. In embodiments, the TAG ejector kit includes one or more screws. In embodiments, the TAG ejector kit includes two screws.

In embodiments, forming a TAG ejector comprises, consists essentially of, or consists of affixing a TAG ejector assembly to a receiver of a MODEL 870® shotgun. In embodiments, the affixing is disposing the threaded portion of a screw through the receiver, and screwing the threaded portion of the screw into a mated threaded hole defined within of the TAG base, further wherein the TAG assembly is situated on the interior surface of the receiver. In embodiments, the affixing is disposing two screws through the receiver and screwing them into mated threaded holes defined within the TAG base. In embodiments, the two screws are disposed through the two holes defined through the receiver by the manufacturer for the purpose of riveting an ejector mechanism thereto.

In embodiments of the TAG ejector, the TAG screws do not contact the TAG spring. In embodiments, the TAG base is adapted and configured to engage the tongue portion of the TAG spring between the TAG base and the MODEL 870® receiver in a cantilevered tongue-and-groove disposition to form the TAG ejector. Accordingly, the TAG base is adapted and configured to be affixed to a MODEL 870® receiver interior surface using two fasteners, wherein the affixing does not cause contact between the TAG spring with any TAG screw.

Further, the TAG base is adapted and configured to be affixed to a MODEL 870® receiver interior surface to obtain secure engagement of the TAG spring between the TAG base and the receiver. Accordingly, in embodiments of the TAG ejector, the TAG spring is in direct contact with the interior surface of the MODEL 870® receiver. By affixing the TAG ejector assembly to the interior surface of the MODEL 870® receiver, the TAG spring tongue portion is contacted with the interior surface of the receiver, and the contacted receiver surface becomes a portion of the TAG ejector.

In embodiments, the TAG spring of a TAG ejector extends from the tongue engagement hole of the TAG base and away therefrom to obtain a position that is operable to eject a spent (used or empty) shotgun shell when the MODEL 870® bolt is retracted by the user after firing the shotgun. Accordingly, the TAG ejector obtains a cantilevered tongue-and-groove disposition of the TAG spring within the tongue engagement recess of the TAG base integrated with the surface of the MODEL 870® receiver; and the cantilevered tongue-and-groove configuration obtains a TAG spring that extends from the tongue engagement hole of the TAG base and away therefrom to obtain an operable ejection position.

When situated in the TAG ejector, the cantilevered tongue-and-groove configuration of the TAG spring obtains resistance to warping, bending, and breakage thereof, compared to the conventional MODEL 870® ejector having a spring staked therethrough with a rivet. In embodiments, the cantilevered tongue-and-groove design of the TAG ejector renders the TAG spring less vulnerable to damage and wear during use than the conventional MODEL 870® ejector, resulting in reduced frequency in the need to repair or replace all or part of the TAG ejector, when compared to a conventional MODEL 870® ejector.

In embodiments, TAG ejector kit components are adapted and configured to be assembled to form a TAG ejector assembly, and the TAG ejector assembly is adapted and configured to be affixed to the interior surface of the receiver of a REMINGTON® MODEL 870® shotgun to form a TAG ejector. In embodiments, the TAG ejector assembly is affixed without modifying the MODEL 870® receiver, that is, by using the conventional MODEL 870® receiver configuration provided by the manufacturer. In embodiments, a TAG ejector assembly is configured for disposing two screws through the two through holes defined in the MODEL 870® receiver by the manufacturer for the purpose of riveting an ejector mechanism thereto. Accordingly, in such embodiments, the TAG ejector assembly may be affixed to a new MODEL 870® as original equipment by the manufacturer; or the TAG ejector kit may be assembled and affixed to an existing MODEL 870® receiver by a subsequent user to replace a broken or inoperable ejector, since in either case the receiver holes of the MODEL 870® are configured to affix a TAG ejector assembly thereto.

In embodiments where the first and second TAG fasteners are first and second screws, and the TAG base first and second fastener holes are first and second mated threaded holes, operably affixing the TAG ejector assembly to the receiver of a MODEL 870® requires only a screwdriver (or similarly configured tool) to affix the TAG ejector assembly to the interior surface of a MODEL 870® receiver. Accordingly, replacement of the TAG ejector assembly, or a portion thereof, may be suitably carried out in the field with relative ease, since no rivets are required and no specialized tools are required.

Additional advantages and novel features of the invention will be set forth in part in the description that follows, and in part will become apparent to those skilled in the art upon examination of the following, or may be learned through routine experimentation upon practice of the invention.

DETAILED DESCRIPTION

Figure 1:
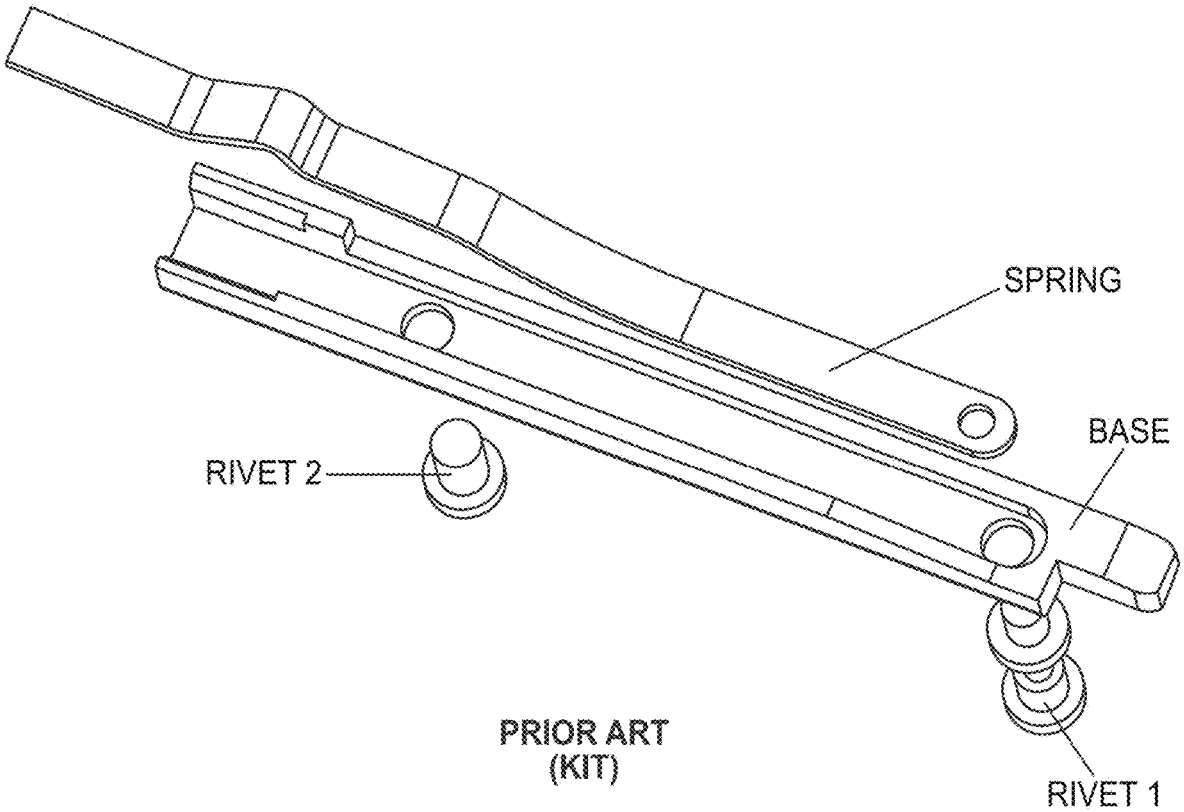
FIG. 1 shows components of an ejector kit of the prior art.

Although the present disclosure provides references to preferred embodiments, persons skilled in the art will recognize that changes may be made in form and detail without departing from the spirit and scope of the invention.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Definitions

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety and for all purposes. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates all embodiments "comprising," "consisting of" and "consisting essentially of," the features or elements recited herein, whether explicitly set forth or not.

As used herein, the term "about" modifying, for example, a dimension of length, width, thickness; the radius of a circle to describe a curved feature; or other measured or observed value, refers to variation in the numerical quantity that can occur, for example, through typical manufacturing procedures; through inadvertent error in these procedures; through differences in the manufacture or source of a material used for manufacture; and like proximate considerations. Where modified by the term "about" the claims appended hereto include equivalents to these quantities. Further, where "about" is employed to describe a range of values, for example "about 1 to 5" the recitation means "1 to 5" and "about 1 to about 5" and "1 to about 5" and "about 1 to 5" unless specifically limited by context.

As used herein, the term "substantially" modifying, for example a property, a measurable quantity, a method, a position, a value, or a range employed in describing the embodiments of the disclosure, refers to a variation that does not affect the overall recited property, quantity, method, position, value, or range thereof in a manner that negates the intended property, quantity, method, position, value, or range. Where modified by the term "substantially" the claims appended hereto include equivalents to the indicated property, quantity, method, position, value, or range thereof.

Discussion

Figure 6:
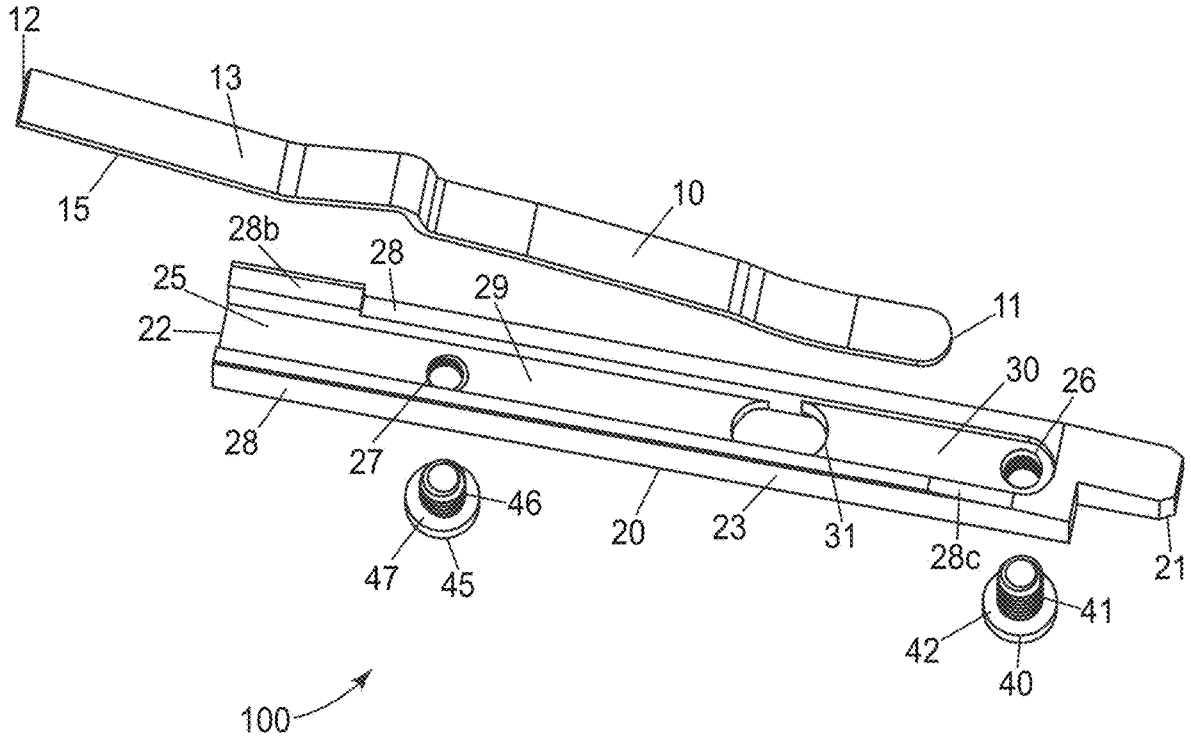
FIG. 6 shows components of a tongue-and-groove (TAG) ejector kit in accordance with the invention.

A representative tongue-and-groove (TAG) ejector kit in accordance with the invention is shown in FIG. 6. In embodiments, a TAG ejector kit comprises, consists essentially of, or consists of TAG ejector components shown in FIG. 6: TAG spring 10, TAG base 20, first fastener 40, and second fastener 45.

Figure 7:
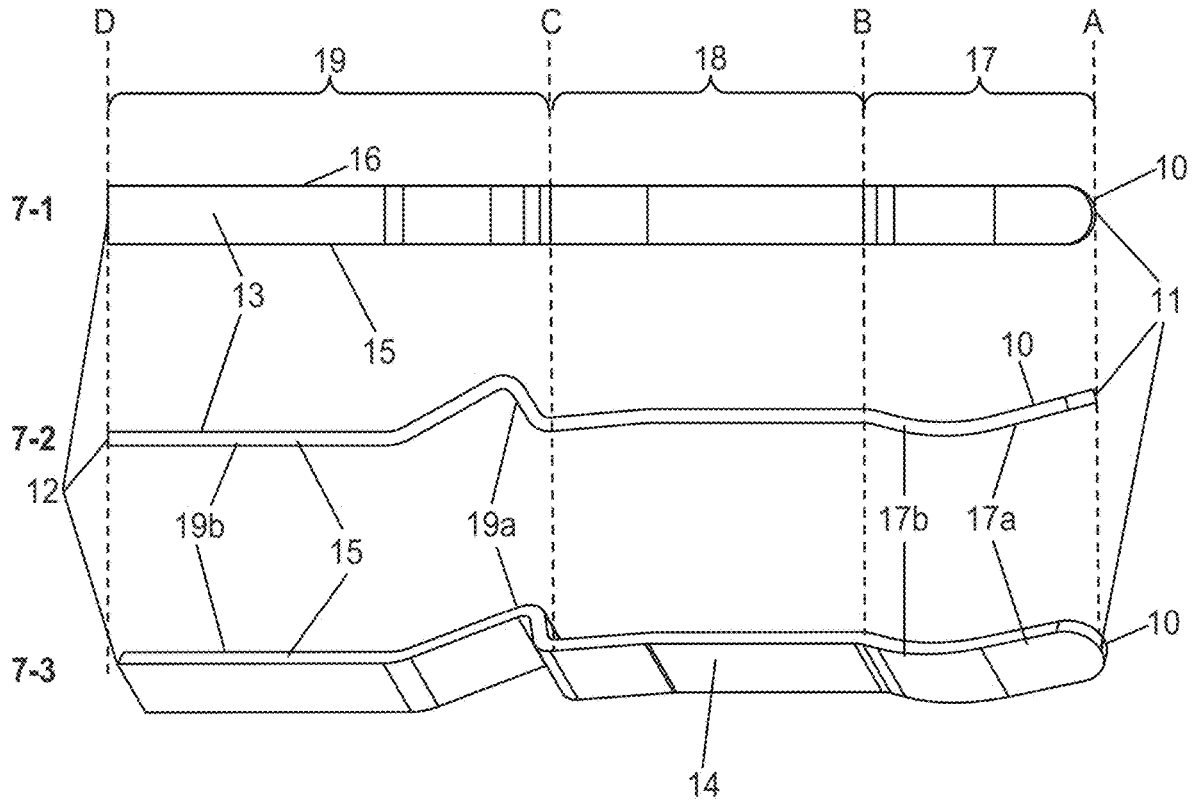
FIG. 7 shows perspective views 7-1, 7-2, 7-3 of a TAG spring in accordance with the invention.

As shown in FIG. 6, TAG spring 10 includes first spring end 11, second spring end 12, first spring major side 13, and first spring edge 15. FIG. 7 shows perspective views 7-1, 7-2, 7-3 of TAG spring 10 having first spring end 11, second spring end 12, first spring major side 13, second spring major side 14, first spring edge 15, and second spring edge 16. The distance between first major spring side 13 and second spring major side 14 define the thickness of TAG spring 10. The distance between first spring edge 15 and second spring edge 16 define the width of TAG spring 10. The distance the between lines A-D in FIG. 7, or alternatively the distance between first spring end 11 and second spring end 12 define the length of TAG spring 10. As shown in FIGS. 6 and 7, TAG spring 10 is substantially monolithic and is free of holes defined therethrough.

Further as shown in FIG. 7, TAG spring 10 includes spring tongue portion 17 which is the spring portion between lines A-B of FIG. 7 that encompasses first spring end 11. Spring tongue portion 17 includes tongue engagement section 17*a* and tongue curved section 17*b*. Tongue engagement section 17*a* is rounded at spring first end 11. Further as shown in FIG. 7, TAG spring 10 includes spring spacer portion 18, which is the spring portion between lines B-C of FIG. 7. Further as shown in FIG. 7, TAG spring 10 includes spring ejector portion 19, which is the spring portion between lines C-D of FIG. 7. Spring ejector portion 19 includes ejector peak section 19*a* and ejector straight section 19*b*. In embodiments, spring ejector portion 19 and spring spacer portion 18 together form the ejector portion of TAG spring.

Figure 8:
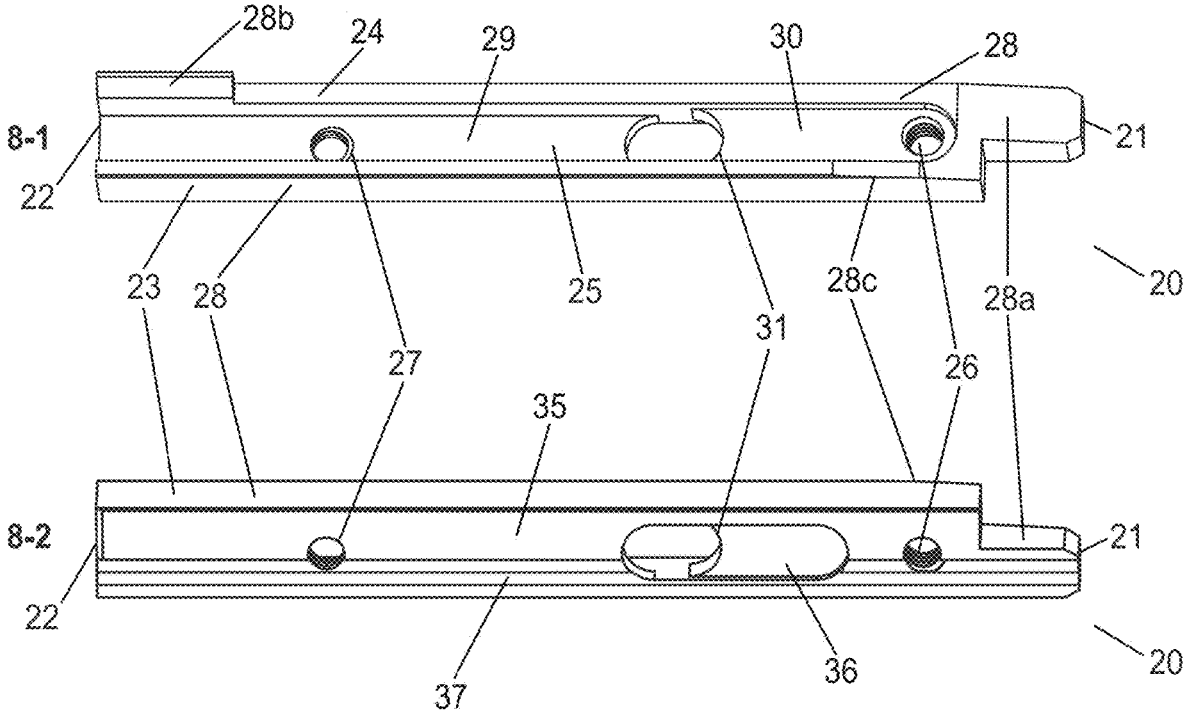
FIG. 8 shows perspective views 8-1, 8-2 of a TAG base in accordance with the invention.

As shown in FIG. 6, TAG base 20 includes first base end 21, second base end 22, first base edge 23, first base major side 25, first fastener hole 26 defined therein, second fastener hole 27 defined therein, rail portion 28, spring landing area 29, spring engagement area 30, and tongue engagement hole 31 defined therein. FIG. 8 shows perspective views 8-1, 8-2 of TAG base 20 showing first base end 21, second base end 22, first base edge 23, second base edge 24, first base major side 25, second base major side 35, first fastener hole 26 defined between first base major side 25 and second base major side 35, second fastener hole 27 defined between first base major side 25 and second base major side 35, rail portion 28 including nose feature, 28*a* riser 28*b*, and shoulder feature 28*c*, spring landing area 29, spring engagement area 30, tongue engagement hole 31 defined between first base major side 25 and second base major side 35, tongue engagement recess 36, and steps 37.

FIGS. 6 and 8 show that rail portion 28 of TAG base 20 proceeds continuously along the entirety of first base edge 23 from second base end 22 to base first end 21, and from base first end 21 along the entirety of second base edge 24 from base first end 21 to base second end 22; and that with first base major side 25 situated horizontally, rail portion 28 of TAG base 20 extends vertically away from first base major side 25. Rail portion 28 includes nose feature 28*a* which extends horizontally from base first end 21. Rail portion 28 further includes riser 28*b*, which extends vertically relative to and away from first base major side 25. Rail portion 28 further includes shoulder feature 28*c*, which is a sloped area defining a decreased vertical extension of rail portion 28 away from first base major side 25.

FIGS. 6 and 8 further show first and second fastener holes 26, 27 defined between first base major side 25 and second base major side 35, such that tongue engagement hole 31 is defined between and positioned between the first fastener hole 26 and the second fastener hole 27. In embodiments, first and second fastener holes 26, 27 are configured to receive first and second fasteners 40, 45. In embodiments, one or more of first and second fasteners are screws, and one or more of first and second fastener holes 26, 27 are threaded in a mating configuration to receive the screws. In embodiments, first and second fastener holes 26, 27 define different distances between first base major side 25 and second base major side 35, different threading, or both different lengths and different threading.

Also shown in FIGS. 6 and 8, spring landing area 29 and spring engagement area 30 define tongue engagement hole 31 therebetween. Tongue engagement hole 31 is a through hole extending from first base major side 25 to second base major side 35. Tongue engagement hole 31 is of a dimension to allow spring tongue portion 17 to extend slidably therethrough. In some embodiments, tongue engagement hole 31 defines a circular, semicircular, polygonal, square, rectangular, or stadium shape. As shown in FIG. 8, tongue engagement recess 36 extends to, defines, and is contiguous with tongue engagement hole 31 on second base major side 35. Accordingly, tongue engagement recess 36 is configured and adapted to receive and engage tongue engagement section 17*a* when spring tongue portion 17 is extended through tongue engagement hole 31 and the extended tongue engagement section 17*a* is disposed within tongue engagement recess 36. As shown in FIG. 8, spring engagement area 30 of TAG base 20 includes tongue engagement recess 36 situated on second base major side 35 thereof, wherein tongue engagement recess 36 is adapted and configured to fit tongue engagement section 17*a* of TAG spring 10.

In embodiments, TAG spring 10 is formed from spring steel. "Spring steel" is a term of art that generally refers to low-alloy manganese, medium-carbon steel or high-carbon steel characterized by high yield strength, a property that allows objects made of spring steel to return to their original shape despite significant deflection or twisting. The classification, or grade, of a spring steel is based on its chemical composition which translates to characteristic properties.

In embodiments, the overall length of TAG spring 10, defined as the distance between A and D in FIG. 7, is between 2 inches (50.8 mm) and 3 inches (76.2 mm), often between about 2.2 inches (55.9 mm) and 2.5 inches (63.5 mm). The length of TAG spring 10 is determined by the gauge of the shotgun receiver, that is, the length of TAG spring 10 is configured and adapted according to intended use in a TAG ejector in a 12 gauge, 16 gauge, 20 gauge, 28 gauge, or .410 bore MODEL 870® shotgun.

In embodiments, the ratio to the overall length of TAG spring 10, defined as the distance A-D in FIG. 7, to the length of tongue engagement section 17*a* is about 12:1 to 8:1, often about 11:1, or about 10:1, or about 9:1. The ratio of spring length to tongue engagement section length enables the secure engagement of TAG spring 10 between tongue engagement recess 36 and receiver surface 210 during operation of the TAG ejector to eject a spent shell.

In embodiments, TAG spring 10 defines a thickness 15, that is, the distance between first and second major sides 13, 14 of 0.01 inches to 0.05 inches, for example 0.01 inch (0.25 mm), or 0.02 inches (0.51 mm), or 0.03 inches (7.62 mm), or 0.04 inches (1.01 mm), or 0.05 inches (1.27 mm). In embodiments, TAG spring 10 includes a width of about 0.10 inches to about 0.20 inches, for example 0.10 inch (2.5 mm), or 0.11 inch (2.8 mm), or 0.12 inch (3.0 mm), or 0.13 inch (3.3 mm), or 0.14 inch (3.6 mm), or 0.15 inch (3.8 mm), or 0.16 inch (4.1 mm), or 0.17 inch (4.3 mm), or 0.18 inch (4.6 mm), or 0.19 inch (4.8 mm), or 0.20 inch (5.1 mm). In embodiments, the distance between lines A-D in FIG. 7 is about 2.20 inches to about 2.50 inches (55.9 mm to 63.5 mm), for example 2.20 inches (55.9 mm), or 2.25 inches (57.2 mm), or 2.30 inches (58.4 mm), or 2.35 inches (59.7 mm), or 2.40 inches (61.0 mm, or 2.45 inches (62.2 mm), or 2.50 inches (63.5 mm).

In embodiments, TAG base 20 is formed from aluminum, steel or titanium. In embodiments, the steel is crucible steel, carbon steel (steel having up to about 2 wt % carbon), maraging steel, stainless steel, high-speed steel, or a steel alloy such as weathering steel or tool steel. In embodiments, TAG base 20 is manufactured additively, that is, by additive methods such as 3D printing; in other embodiments TAG base 20 is manufactured subtractively, that is, by machining of a piece of metal to remove portions thereof. In embodiments, TAG base 20 is subtractively formed from a single piece of metal.

In embodiments, the first and second fasteners 40, 45 are formed from aluminum, steel or titanium. In embodiments, the steel used to make fasteners 40, 45 is crucible steel, carbon steel (steel having up to about 2 wt % carbon), maraging steel, stainless steel, high-speed steel, or a steel alloy such as weathering steel or tool steel. In embodiments, fasteners 40, 45 are manufactured additively, that is, by additive methods such as 3D printing; in other embodiments fasteners 40, 45 are manufactured subtractively, that is, by machining of a piece of metal to remove portions thereof.

In embodiments, the first and second fastener heads 41, 46 are cap head screws, domed head screws, or flat head screws; in some such embodiments, cap head or flat head screws are preferred in order to avoid the protrusion of the screw head from the base when the TAG ejector is affixed. In some embodiments, the first and second fastener heads 41, 46 are painted to match a color or the color of a specific MODEL 870® receiver exterior. In some embodiments, the screw heads are finished by an iron, zinc, or manganese phosphating process known as "parkerizing". In some embodiments, the screw heads are finished by bluing, such as hot bluing, cold bluing, rust bluing, charcoal bluing, or nitre bluing.

Figure 9A:
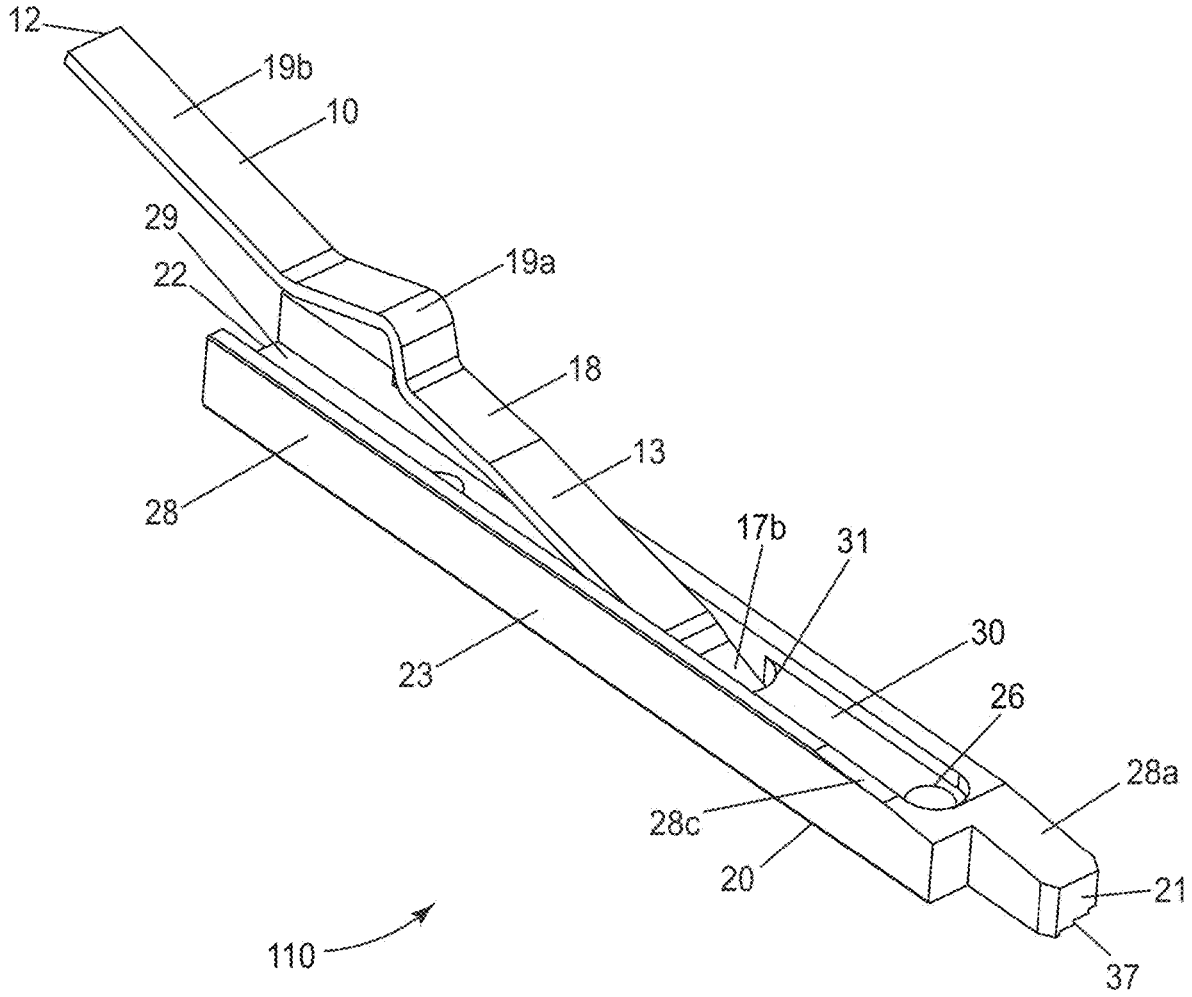
FIG. 9A shows a perspective view of a TAG assembly in accordance with the invention.
Figure 9B:
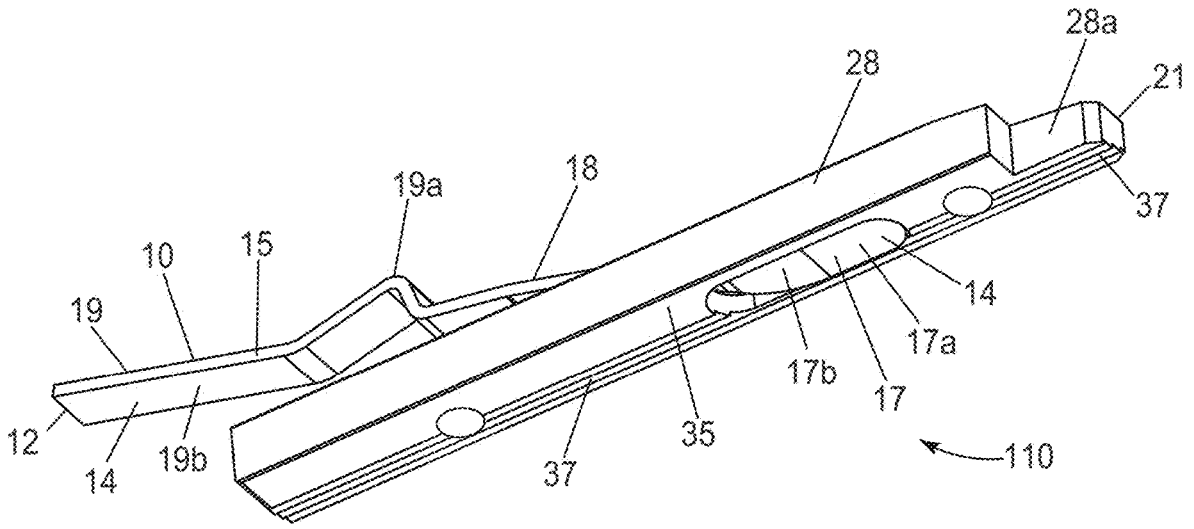
FIG. 9B shows another perspective view of a TAG assembly in accordance with the invention.

FIGS. 9A and 9B show different perspective views of TAG assembly 110, formed by extending tongue portion 17 of TAG spring 10 through tongue engagement hole 31 of TAG base 20; and engaging tongue engagement section 17*a* with tongue engagement recess 36 such that tongue engagement section 17*a* substantially fills tongue engagement recess 36 and is flush or substantially flush with respect to the overall plane of second base major side 35.

Accordingly, as shown in FIGS. 9A and 9B, spring tongue portion 17 of TAG assembly 110 is extended through tongue engagement hole 31; and tongue engagement section 17*a* is engaged within tongue engagement recess 36, while tongue curved section 17*b* curves toward and extends through tongue engagement hole 31.

FIG. 9B further shows that first spring end 11 obtains a convex arcuate or semicircular shape; while tongue engagement recess 36 obtains a mated concave arcuate or semicircular shape that allows tongue engagement section 17*a* to fit within and in touching relation thereto everywhere or substantially everywhere within tongue engagement recess 36. In some embodiments, first spring end 11 is not arcuate, e.g. is polygonal or angular, or defines another shape. The shape of first spring end 11 is not particular limited; however, first spring end 11 must obtain a shape and size that fits within tongue engagement recess 36 to obtain a flush disposition of tongue engagement section 17*a* with respect to TAG base second base major side 35, as shown in FIG. 9B.

Accordingly, in embodiments, assembly of a TAG ejector kit to form a TAG ejector assembly 110 comprises, consists essentially of, or consists of inserting TAG spring 10 tongue portion 17 through tongue engagement hole 31 of TAG base 20, in a direction from first base major side 25 toward second base major side 35; and engaging tongue engagement section 17*a* with the tongue engagement recess 36 of TAG base 20. In this manner, the TAG spring 10 and TAG base 20 are assembled to form TAG ejector assembly 110, as shown in FIGS. 9A and 9B.

In the TAG assembly 110 of FIGS. 9A and 9B, no part of spring tongue portion 17 extends beneath second major side 35 of TAG base 20. That is, tongue engagement section 17*a* of TAG spring 10 fills, or substantially fills tongue engagement recess 36 of TAG base 20 when the TAG spring 10 and TAG base 20 are assembled to form a TAG assembly 110; and further, when TAG assembly 110 is situated horizontally with second base major side 35 directed downward, tongue engagement section 17*a* substantially fills tongue engagement recess 36 but does not protrude vertically downward from second base major side 35, thereby providing a flush disposition of tongue engagement section 17*a* with respect to second base major side 35.

Figure 2:
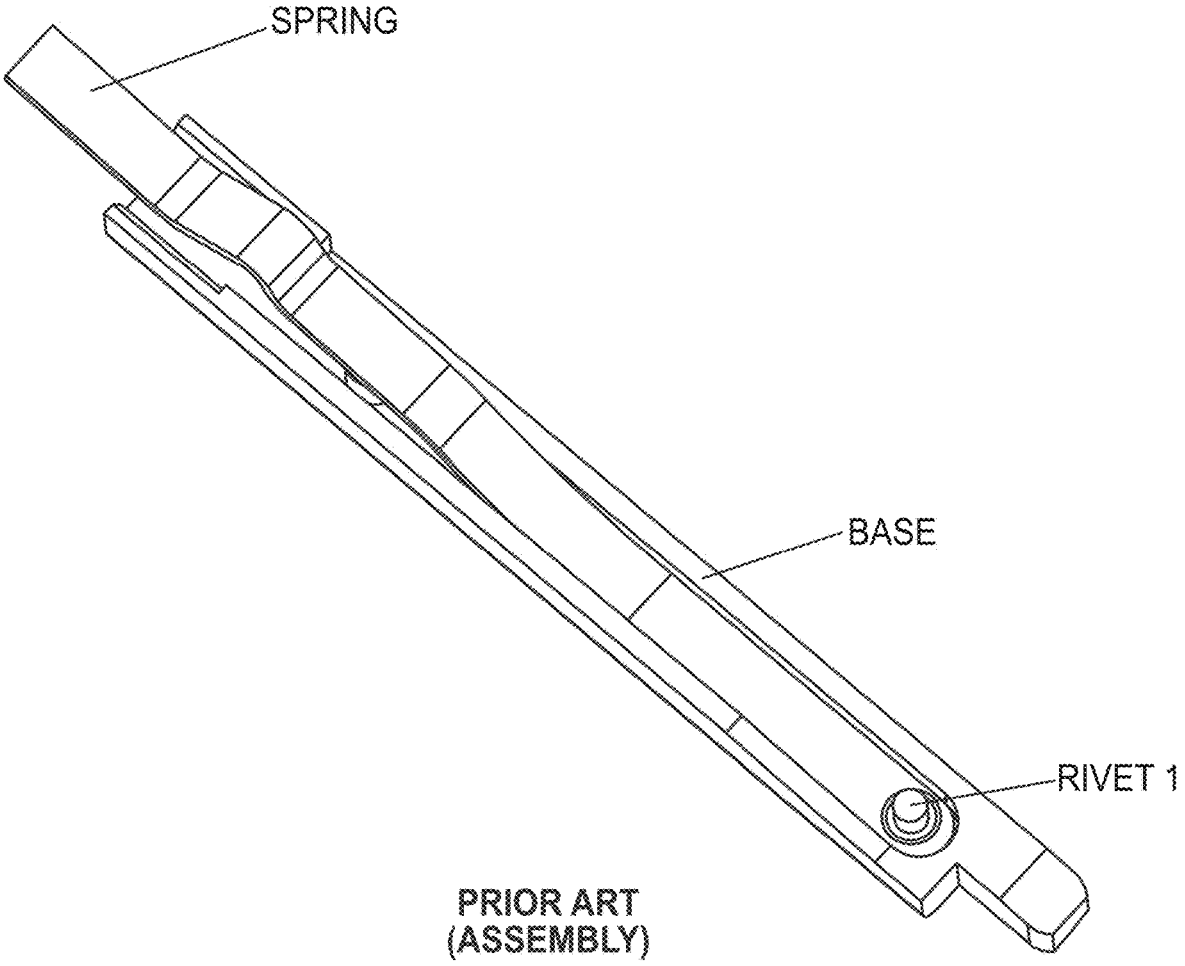
FIG. 2 shows an ejector assembly of the prior art.

Further as shown in FIGS. 9A and 9B, engaging tongue engagement section 17*a* with tongue engagement recess 36 such that tongue engagement section 17*a* substantially fills tongue engagement recess 36 and further positions tongue curved section 17*b* to extend through tongue engagement hole 31, which in turn causes spring spacer portion 18, and spring ejector portion 19 to extend away from TAG base 20. Spring spacer portion 18 may be substantially flat, or it may include one or more angular adjustments thereto. Spring ejector portion 19 extends from spring spacer portion 18. Spring ejector portion 19 is the portion of TAG spring 20 that is operable to contact and eject a spent shell (also "shotshell") from the MODEL 870® receiver area when TAG assembly 110 is affixed thereto. Spring ejector portion 19 is positioned for operable contact by virtue of the engagement of tongue engagement section 17*a* with tongue engagement recess 36, which in turn causes curved section 17*b* to proceed through tongue engagement hole 31 and urge spring spacer portion 18 away from TAG base 20, placing spring ejector portion 19 in a position operable to contact and eject a spent shell from the MODEL 870® receiver area when TAG assembly 110 is affixed thereto. In embodiments, when a TAG ejector assembly is affixed to the interior of a MODEL 870® receiver, ejector peak section 19*a* and ejector straight section 19*b* of TAG spring 10 are adapted and configured to obtain the same or substantially the same shape and position as a conventional MODEL 870® ejector spring when staked by rivet 1, as can be seen in FIG. 9A in comparison with FIG. 2.

In embodiments, forming a TAG ejector comprises, consists essentially of, or consists of forming a TAG ejector assembly; and affixing the TAG ejector assembly to the interior of the receiver of a shotgun, such as a pump action shotgun. As discussed above, forming a TAG assembly 110 includes extending spring tongue portion 17 of TAG spring 10 through tongue engagement hole 31 of TAG base 20; and engaging tongue engagement section 17*a* of TAG spring 20 with tongue engagement recess 36 of TAG base 20 to form a TAG assembly 110 as shown in FIGS. 9A and 9B.

Methods of forming a TAG ejector from TAG assembly 110 include positioning a TAG assembly on the interior surface of a MODEL 870® receiver such that second base major side 35 and tongue engagement section 17*a* contact the interior surface of the receiver, further wherein first base edge 23 of the TAG base is situated proximal to the barrel portion of the MODEL 870®; and affixing the positioned TAG assembly to the receiver to form a TAG ejector by affixing first and second fasteners 40, 45 shown in FIG. 6.

Figure 3:
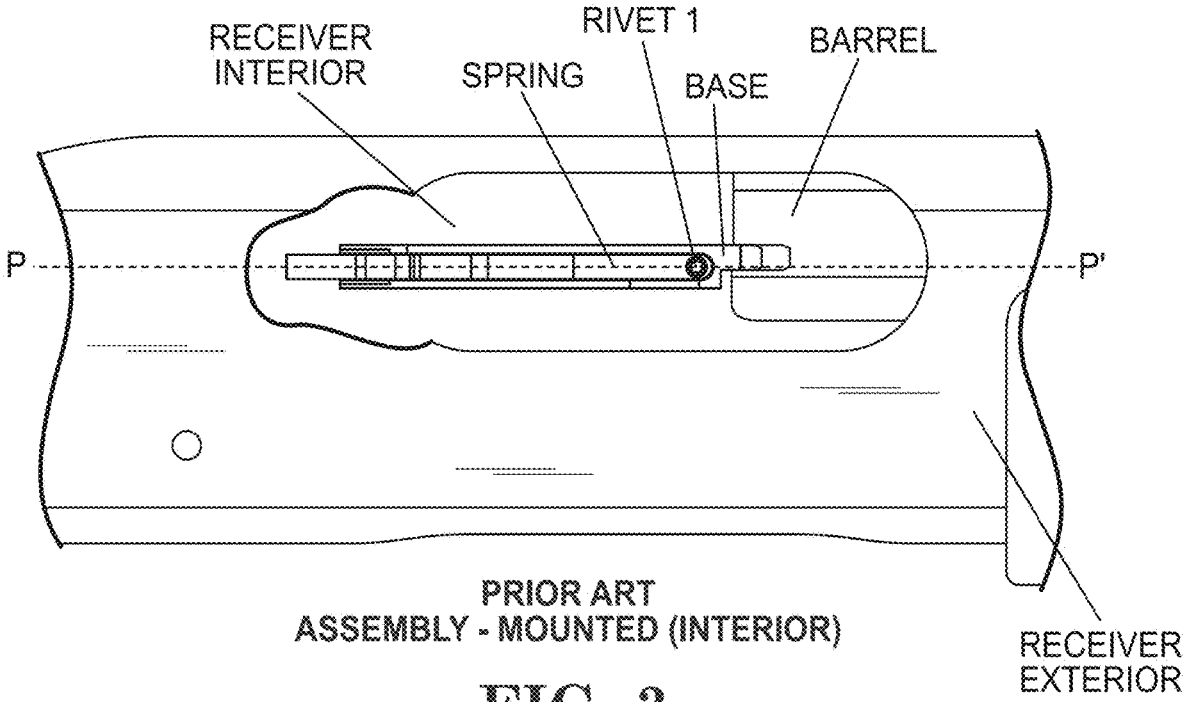
FIG. 3 is a cutaway view of a MODEL 870® receiver showing the interior thereof, the interior having an ejector of the prior art mounted thereto.
Figure 4:
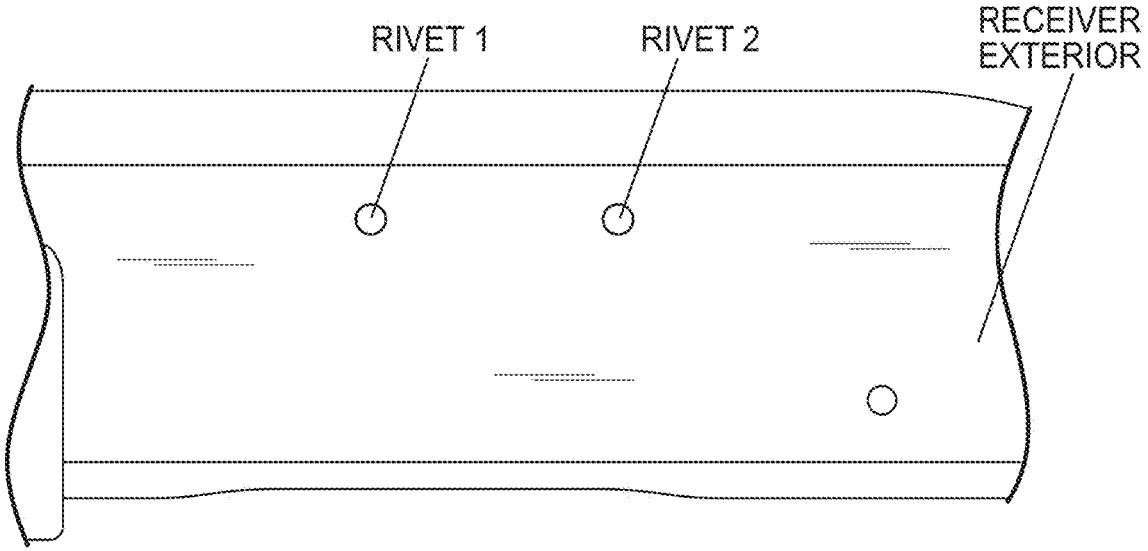
FIG. 4 is an exterior view of the MODEL 870® receiver of FIG. 3.
Figure 5:
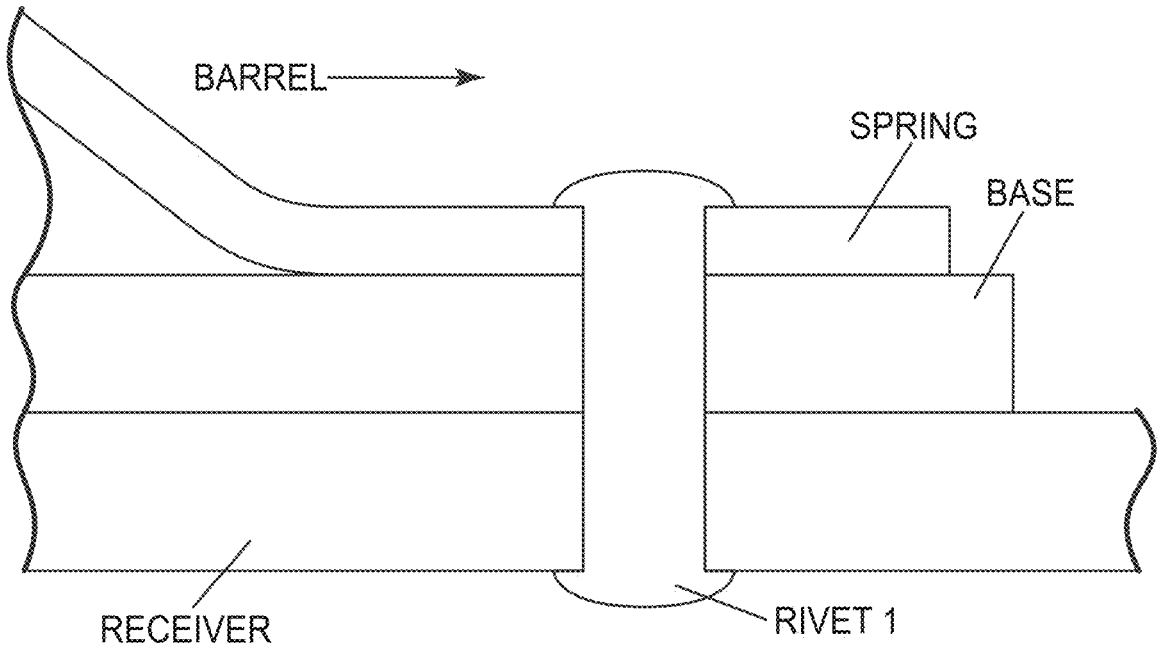
FIG. 5 is a schematic representation of a cross section of a portion of the mounted ejector of FIG. 3 taken along the line P-P'.
Figure 10:
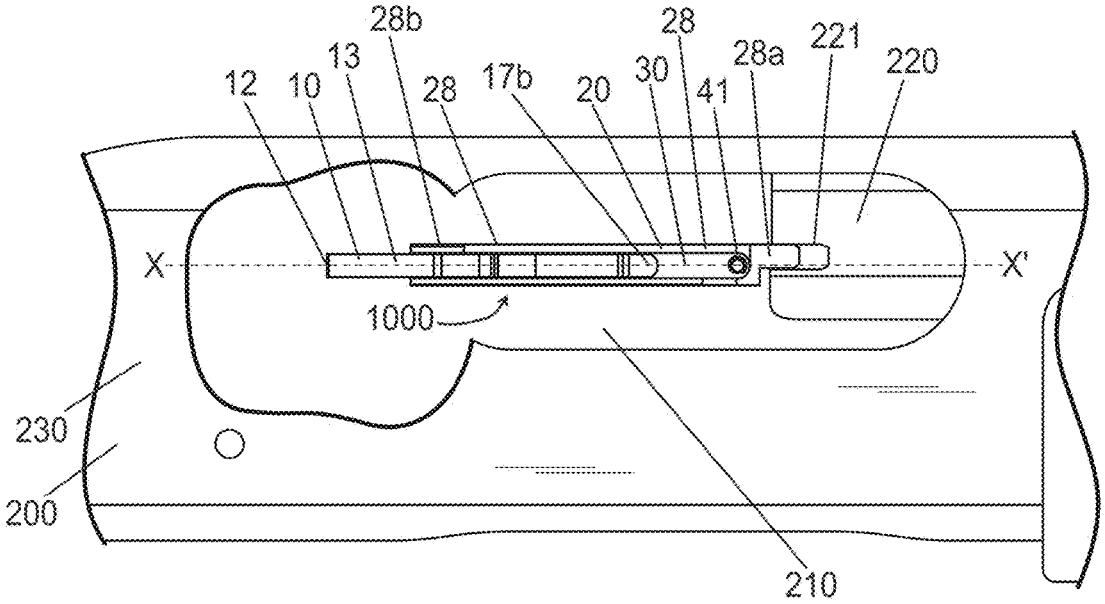
FIG. 10 is a cutaway view of a MODEL 870® receiver showing the interior thereof, having a TAG ejector in accordance with the invention affixed thereto.

FIG. 10 is a cutaway view showing a TAG ejector 1000 affixed to the receiver interior surface 210 of a pump action shotgun 200; the exterior surface of shotgun 200 is shown as 230. As shown in FIG. 10, first fastener 41 is visible proximal to spring engagement area 30 of TAG base 20; and tongue curved section 17*b* of first spring major side 13 is visible extending from tongue engagement hole 31 of TAG base 20 first base major side 25. Also visible in FIG. 10 is nose feature 28*a*, which is configured and adapted to engage with a notch 221 provided by the manufacturer in the barrel of the MODEL 870® for the purpose of engaging a conventional ejector mechanism thereto, as shown in FIG. 3. Accordingly, as shown in FIG. 10, nose feature 28*a* obtains alignment of ejector 1000 with the barrel 220 and receiver 200; and maintains the alignment of ejector 1000 during use, that is, when the pump action of ejecting a spent shell from the shotgun causes a torque to be applied to the ejector 1000.

Riser 28*b* further obtains alignment of TAG spring 10 during use of the ejector 1000. More specifically, spring landing area 29 surrounded by rail 28 and riser 28*b*, obtains alignment of TAG spring 10, from tongue curved section 17*b* to second spring end 12, during use of the ejector 1000. The alignment is beneficial during operation of TAG ejector 1000, when the pump action of the ejector compresses the spring and causes contact of ejector peak section 19*a* with a spent shell; and direction of the compression of the spring is guided and aligned within spring landing area 29 by the rail 28 along with riser 28*b*.

Affixing TAG assembly 110 of FIGS. 9A and 9B to a receiver of a MODEL 870® shotgun to form a TAG ejector 1000 as shown in FIG. 10 comprises, consists essentially of, or consists of a) contacting second base major side 35 of TAG base 20 of TAG assembly 110 with the interior surface 210 of a MODEL 870® receiver, such that first base edge 23 is situated proximal to the barrel portion of the MODEL 870®; b) engaging nose feature 28*a* with a notch of the MODEL 870® barrel; c) disposing first threaded portion 42 of first fastener 40 through a first hole defined in the receiver, and screwing first threaded portion 42 into first fastener hole 26 from TAG base second base major side 35 toward TAG base first major side 25, further wherein first fastener hole 26 is a mated threaded hole adapted and configured to receive first threaded portion 42, and TAG second base major side 35 is positioned to receive first threaded portion 42 as it is disposed through the receiver; and d) disposing second threaded portion 47 of second fastener 45 through a second hole defined in the receiver, and screwing second threaded portion 47 into second fastener hole 27 from second base major side 35 toward first base major side 25, further wherein second fastener hole 27 is a mated threaded hole adapted and configured to receive second threaded portion 47, and TAG base second base major side 35 is positioned to receive second threaded portion 47 of second fastener 45 as it is disposed through the receiver. In embodiments, first and second fasteners are disposed through the receiver using two existing rivet holes placed in the MODEL 870® receiver by the manufacturer. the TAG assembly is situated with TAG base second major side 35 contacting the receiver interior surface.

As shown in FIG. 6, first fastener 40 includes first fastener head 41 and first threaded portion 42; and second fastener 45 includes second fastener head 46 and second threaded portion 47. Further, first and second fastener holes 26, 27 of TAG base 20 are mated threaded holes, that is, adapted and configured to receive the threaded portion of first and second fasteners 40, 45. In embodiments first and second fastener holes 26, 27 are the same or are substantially the same; in other embodiments, first fastener hole 26 is adapted and designed to be mated with first fastener threaded portion 42; second fastener hole 27 is adapted and designed to be mated with second fastener threaded portion 47; and the first mated fastener/hole pair 42/26 is different from the second mated fastener/hole pair 47/27.

Figure 11:
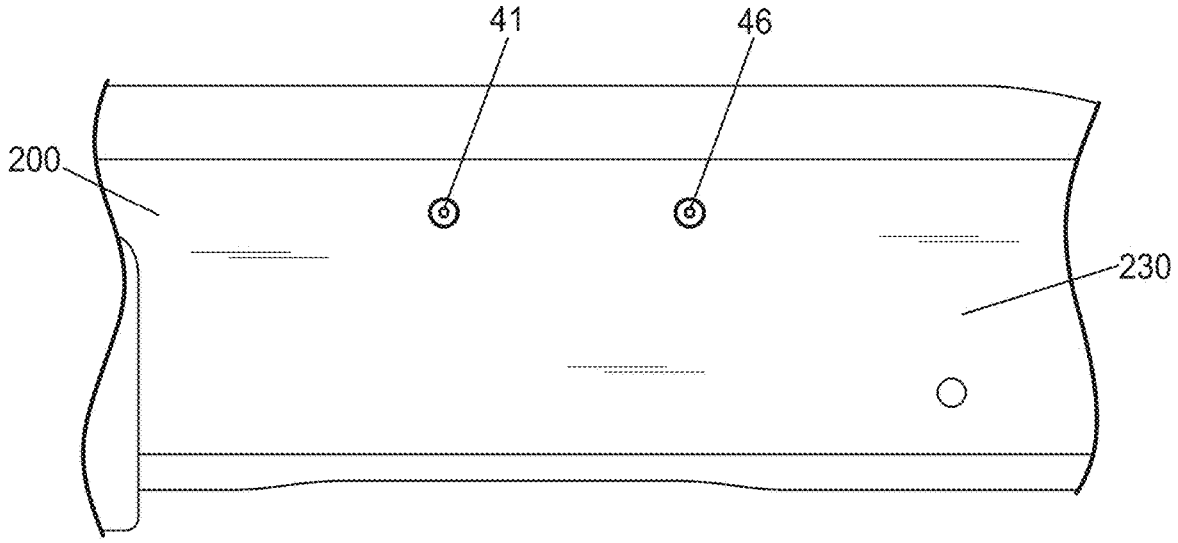
FIG. 11 is an exterior view of the MODEL 870® receiver of FIG. 11.

FIG. 11 shows an exterior portion 230 of the receiver 200 having TAG ejector 1000 affixed thereto, further wherein first fastener head 41 of first fastener 40 and second fastener head 46 of second fastener 45 are visible. The first and second fasteners 40, 45 are disposed through first and second rivet holes of receiver 200.

Figure 12:
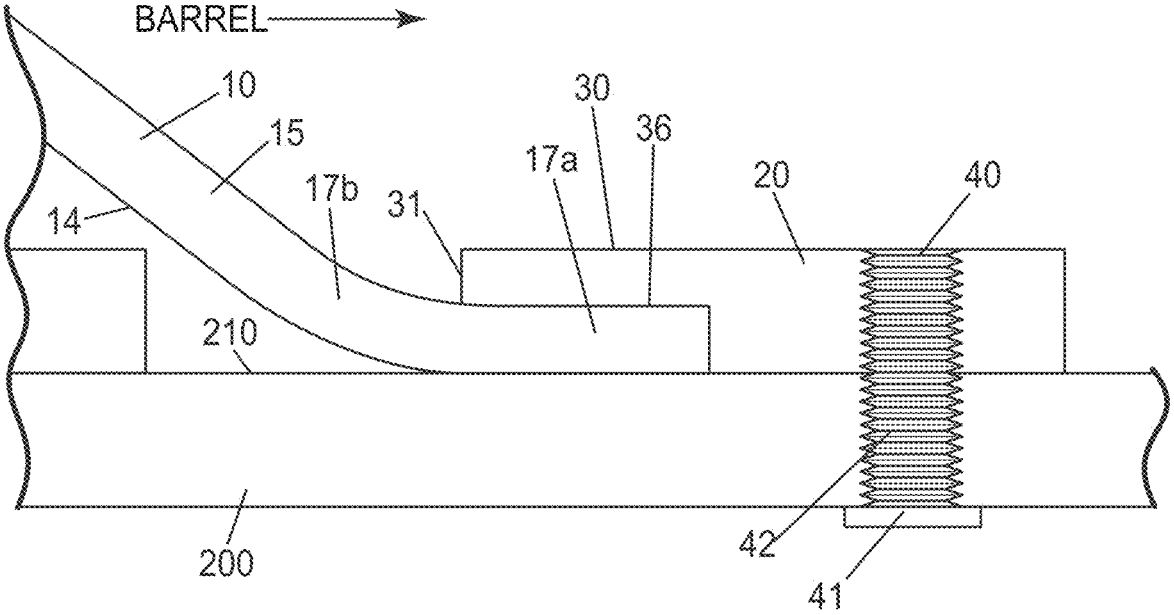
FIG. 12 is a schematic representation of a cross section of a portion of the ejector of FIG. 11 taken along the line X-X'.

FIG. 12 is a schematic representation of a cutaway view of a section of a TAG ejector 1000 affixed to the interior surface of a MODEL 870® receiver, taken through line X-X' in FIG. 10. It can be seen in FIG. 12 that first fastener 40 extends through receiver 200 and TAG base 20; and spring 10 is not staked, affixed, or riveted to the receiver 200. That is: fastener 40 does not contact TAG spring 10. Accordingly, in embodiments, the TAG base is adapted and configured to be affixed to a MODEL 870® receiver using screws, wherein the affixing does not cause contact between the TAG spring with any TAG screw. Even in embodiments where the TAG assembly is adapted and configured to be affixed to a MODEL 870® receiver using rivets, that is, first and second fasteners 40, 45 are rivets and not screws, affixing the TAG assembly to form a TAG ejector does not cause contact between the TAG spring with the TAG fasteners.

It can further be seen in FIG. 12 that TAG spring 10 contacts receiver interior surface 210, specifically, that TAG spring 10 second spring major side 14 contacts receiver interior surface 210 over the entirety of tongue engagement section 17*a*. It can also be seen in FIG. 12 that tongue engagement section 17*a* of TAG spring 10 is securely engaged between tongue engagement recess 36 of TAG base 20, and the MODEL 870® receiver interior surface 210 in a cantilevered tongue-and-groove disposition, wherein tongue curved section 17*b* extends through tongue engagement hole 31 and away from receiver interior surface 210.

Finally, it can be seen in FIG. 12 that first fastener threaded portion 42 of first fastener 40 obtains a flush relationship with respect to the first base major side 25 when TAG ejector 1000 is affixed to receiver interior surface 210. It is an advantage of the TAG fastener design that by avoiding the use of rivets, a flush relationship of one or both of first and second fasteners 40, 45 with respect to the first base major side 25 can be obtained by matching the length of the screw threaded portions 42, 47 with the distance between first and second base major sides 25, 35 combined with the distance between the exterior and interior of the MODEL 870® receiver. The flush disposition of the screws with respect to first base major side 25 of affixed TAG ejector 1000 is a configuration that cannot be obtained using rivets as fasteners, and accordingly the use of screws that is enabled by the TAG ejector design represents an advantage over the conventional ejector design represented in FIGS. 1-5.

Further as shown in FIG. 11, the TAG spring 10 tongue engagement section 17*a* is in direct contact with the interior surface 210 of the MODEL 870® receiver. By affixing the TAG ejector assembly to the interior surface of the MODEL 870® receiver, the TAG spring 10 tongue engagement section 17*a* is contacted with the interior surface of the receiver on second spring major side 14, and thereby the receiver becomes an integral part of the TAG ejector.

Figure 13:
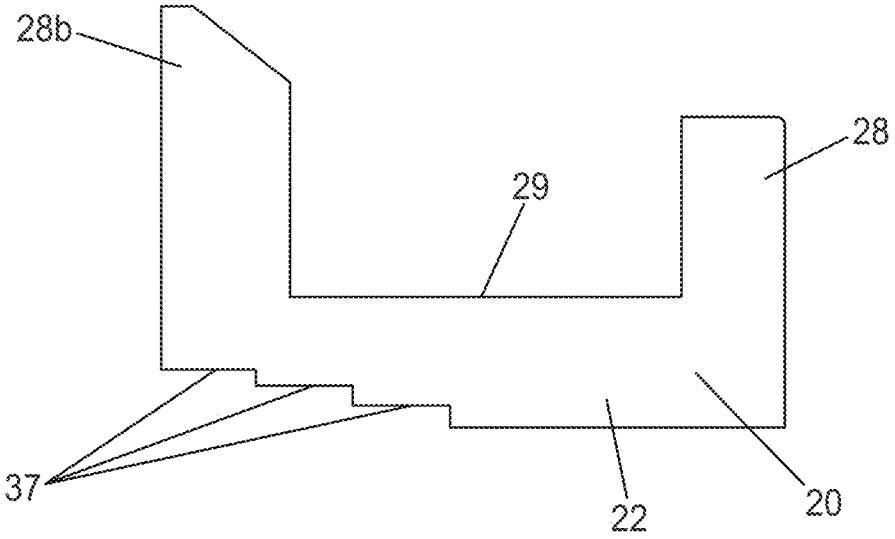
FIG. 13 is a profile outline of one end of a TAG base end in accordance with the invention.

During the affixing of TAG ejector assembly 100, and in affixed TAG ejector 1000, the benefits of steps 37 of TAG base 20, shown in FIGS. 8 and 9B, further become apparent. As shown in FIG. 8 view 8-2, a plurality of steps 37 are defined on TAG base 20 second base major side 35, extending from first base end 21 to second base end 22. FIG. 13 shows a profile outline of second base end 22 of TAG base 20, which highlights the positioning and shape of steps 37. Steps 37 obtain dimensions configured and adapted to provide a close fit of TAG base 20 second base major side 35 with the interior receiver surface 210 of receiver 200, wherein interior receiver surface 210 is a curved surface. Specifically, steps 37 are configured to produce a touching relationship between receiver surface 210 and TAG spring 10 second spring major side 14 at tongue engagement section 17*a* in TAG ejector 1000, enabling the secure engagement of the TAG spring 10 between the TAG base 20 and the curved interior receiver surface 210. Accordingly, in TAG ejector 1000, tongue engagement section 17*a* of TAG spring 10 is securely engaged with and between the MODEL 870® receiver surface 210 and the tongue engagement recess 36 of TAG base 20 that is affixed to the receiver by first and second fasteners 40, 45; further wherein the receiver interior surface 210 is defined by a diameter.

That is, in TAG ejector 1000, steps 37 are configured and adapted to provide an overall configuration wherein second base major side 35 is fitted or substantially fitted against curved receiver interior surface 210, wherein the curve of receiver interior surface 210 is determined by the radius of curvature of the receiver bore, that is, the gauge of the shotgun. In this manner, TAG ejector 1000 provides secure engagement of tongue engagement section 17*a* disposed in a TAG configuration within tongue engagement recess 36, that is, between the MODEL 870® receiver surface 210 and second base major side 35 of TAG base 20.

Alternatively, instead of steps 37, TAG base 20 may include a curved portion, that is, a radius extending from first base end 21 to second base end 22, wherein the radius corresponds to the diameter of the curved receiver interior surface 210. The diameter of the curved receiver interior surface 210 is designed, adapted, and configured to fit the receiver bore.

The shotgun gauge (12 gauge, 16 gauge, etc.) refers to both a diameter of the shotgun bore (barrel), and to the size of the ammunition used, and accordingly shotguns are manufactured having a variety of receiver inner diameters. Common shotgun gauges and corresponding bore diameters re shown in Table 1.

TABLE 1

Common shotgun gauges and corresponding bore diameter.

| Gauge or caliber | Bore diameter, inches (mm) |
|---|---|
| .410* | 0.410 (10.4) |
| 28 | 0.550 (14.0) |
| 20 | 0.615 (15.6) |
| 16 | 0.662 (16.8) |
| 12 | 0.729 (18.5) |
| 10 | 0.775 (19.7) |

*Caliber

It will be appreciated that any one or more of the foregoing TAG ejector kits and TAG ejector assemblies are suitably configured and adapted to fit any one or more of the bore diameters of Table 1, or another bore diameter, to obtain a TAG ejector. Further, it will be appreciated that any pump-action shotgun, or any automatic shotgun may be suitably configured to obtain a TAG ejector configuration, wherein an ejector spring includes a tongue portion, a base member including a recess to engage the tongue portion of the ejector spring between the base member and the receiver of the shotgun; and the base is affixed to the receiver with the spring tongue portion engaged within the base member recess, whereby the ejector spring is operably configured and positioned to eject a shotshell from the shotgun receiver. In any one or more such embodiments, the TAG ejector is affixed through the receiver, using rivets or screws.

In embodiments, the tongue-and-groove design of the TAG ejector renders the TAG spring less vulnerable to damage and wear during use than the conventional MODEL 870® ejector, resulting in reduced frequency in the need to repair or replace all or part of the TAG ejector in comparison to the conventional MODEL 870® ejector.

In embodiments, operably affixing the TAG ejector assembly to the receiver of a MODEL 870® does not require specialized tools, and in embodiments requires only a screwdriver (or similarly configured tool) to affix the TAG ejector assembly to a MODEL 870® receiver. Accordingly, replacement of the TAG ejector assembly, or a portion thereof, may be suitably carried out in the field with relative ease, since no rivets are required. In embodiments, an existing conventional ejector is suitably removed, such as by cutting one or more rivets and emptying the ejector from the receiver; and a TAG ejector assembly is affixed to the empty receiver by forming a TAG assembly and affixing the assembly to the interior surface of the receiver using two screws.

In embodiments, a further benefit of the TAG base is enabled by the use of screws instead of rivets for affixing the TAG ejector assembly to the receiver of a MODEL 870®. The benefit is understood by comparing the dimensions of the TAG base to the dimensions of the corresponding

Experimental Section

Example 1

Components for a tongue-and-groove ejector were machined to fit a REMINGTON® MODEL 870® 12 gauge shotgun.

A spring member having the shape and features shown in FIG. 7 was machined from 0.03 inch (0.76 mm) thick spring steel. The width of the spring member is 0.14 inches (3.6 mm) and the overall length of the spring member (represented by the distance A-D in FIG. 7) is 2.39 inches (60.7 mm). The spring member has a full round (semicircle) shape defined at first end 11 as shown in FIG. 7, and a flat section extending 0.24 inches (6.1 mm) from first end 11 to meet a curved section. The flat section having a full round end shape corresponds to the tongue engagement section 17*a* as shown in FIG. 7; and the curved section corresponds to tongue curved section 17*b* as shown in FIG. 7.

A base member having the shape and features shown in FIG. 8 was machined from 1018 cold rolled steel. As shown in FIG. 8, the base is 2.38 inches (60.4 mm) from first base end 21 to second base end 22. Two through-holes, shown as first and second fastener holes 26, 27 in FIG. 8 were threaded to engage 5-44 socket head screws; and a stadium-shaped hole, 0.24 inches (6.1 mm) by 0.16 inches (4.1 mm), shown as tongue engagement hole 31 defined in the base of FIG. 8, was defined between a point 1.28 inches (32.5 mm) from second base end 22 of FIG. 8 and a point 1.52 inches (38.6 mm) from second base end 22.

The base top, corresponding to first base major side 25 as shown in FIG. 8, includes a rail, corresponding to rail portion 28 as shown in FIG. 8; a nose feature corresponding to nose feature 28*a* of FIG. 8; a riser corresponding to riser 28*b* of FIG. 8; and a shoulder corresponding to shoulder feature 28*c* of FIG. 8, each of which were machined for operability when the base and spring are engaged and affixed to the receiver interior of a REMINGTON® MODEL 870® 12 gauge shotgun.

On the base bottom, that is, second base major side 35 as shown in FIG. 8, a recess corresponding to tongue engagement recess 36 as shown in FIG. 8 was defined contiguous to tongue engagement hole 31, and extending toward first base end 21. The tongue engagement recess was machined to have a depth of 0.03 inches (0.76 mm) and a shape corresponding to the full round (semicircle) shape defined at the first end of the spring, and a length sufficient to accommodate the tongue engagement section of the spring.

Also on the base bottom, three steps corresponding to steps 37 as shown in FIG. 8 were machined to produce an overall shape on the base bottom that corresponds to the diameter of the bore of a REMINGTON® MODEL 870® 12 gauge shotgun.

The thickness of the base between first and second major base sides 25, 35 is 0.075 inches (1.91 mm) in the area extending from second base end 22 to the edge of the base defining the tongue engagement hole 31; while the thickness of the base is 0.121 inches (3.07 mm) in the area of the base extending from tongue engagement recess 36 to rail portion 28 in the area proximal to nose feature 28*a*. The thickness of the base in these two areas defined the length of the screw required for engaging first and second fastener holes (26, 27 in FIG. 8), which as noted above were threaded to engage 5-44 socket head screws.

A 5-44 cap head screw having a total length of 0.240 inches (6.10 mm) was obtained for use as first fastener 40; and a 5-44 cap head screw having a total length of 0.187 inches (4.75 mm) was obtained for use as second fastener 45.

The spring member and base member were assembled by inserting spring first end 11 as shown in FIG. 7, through base tongue engagement hole 31 as shown in FIG. 8; and extending the inserted spring to seat the spring first end within tongue engagement recess, as shown in FIGS. 9A and 9B. The seated tongue engagement section of the spring did not protrude from the plane described generally by the base bottom (steps aside).

A REMINGTON® MODEL 870® 12 gauge shotgun was modified to remove the factory installed ejector by cutting off the two rivets staked to the ejector through the receiver. Then the TAG assembly was positioned within the receiver interior surface, such that the steps contacted the receiver interior surface and the nose feature engaged with a notched barrel section located at the end of the MODEL 870® receiver (shown as 221 in FIG. 10). This position caused the first and second fastener through-holes machined into the base of the TAG assembly to serially align with the two through-holes in the MODEL 870® receiver previously vacated by cutting the rivets.

Then first fastener 40 was extended through one of the two MODEL 870® receiver through-holes, providing mated engagement of first threaded portion 42 with first fastener hole 26 of the base; and second fastener 45 was extended through the second of the two MODEL 870® receiver through-holes to provide mated engagement of second threaded portion 47 with second fastener hole 27 of the base. Once the first fastener 40 was fully engaged within second fastener hole 27 and tightened manually using a screwdriver, the first fastener 40 was observed to be flush with base first major side 25 in the area proximate to the first fastener hole 26. Similarly, once second fastener 45 was fully engaged and tightened manually using a screwdriver, second fastener 45 was observed to be flush with base first major side 25 in the area proximate to the first fastener hole 27.

Additionally, certain features of the base were compared to corresponding features of the base of the PRIOR ART, as represented in FIGS. 1-5 herein. Specifically, as noted above, the thickness of the base in the region between first and second major base sides 25, 35 is 0.075 inches (1.91 mm) in the area of the base defining first fastener hole 26; while the thickness of the base is 0.121 inches (3.07 mm) in the area of the base surrounding the second fastener hole. The corresponding areas of the PRIOR ART base, that is, the area of the PRIOR ART base proximal to the holes defined therein for engaging Rivet 1 and Rivet 2, are shown in FIG. 1. The area of the PRIOR ART base defining both of the holes for engaging Rivet 1 and Rivet 2 and extending between them, is 0.052 inches (1.32 mm) thick.

Comparatively, the base of this Example is 0.023 inches (0.58 mm) thicker than the PRIOR ART base in the area of the base surrounding first fastener hole 26, that is, about 44% thicker than the base of the PRIOR ART; and the base of this Example is 0.069 inches (1.75 mm) thicker than the PRIOR ART base in the area of the base surrounding the second fastener hole, that is, 133% thicker than the base of the PRIOR ART.

As noted above, the thickness of the base in the area surrounding the fastener holes defines the length of the screw required for engaging first and second fastener holes (26, 27 in FIG. 8), and it is an advantage of the present ejector design that the screws can be easily obtained to provide a flush arrangement. Another advantage of the present ejector design is that due to the flush arrangement of the fasteners, no clearance is needed to accommodate rivet heads, which cannot obtain a flush arrangement. That is, the thickness of the PRIOR ART base is limited by the need to provide clearance for protruding rivet heads; while the use of screws allows for this "clearance" space to instead be added to the base, thereby enabling a thicker, more robust base. Accordingly, the present ejector base is significantly stronger, in particular proximal to first end 21 thereof, than the corresponding PRIOR ART base.

Example 2

The ejection of shotshells from the shotgun of Example 1 was compared to the ejection of shotshells from a REMINGTON MODEL 870® 12 gauge shotgun having a factory-installed ejector affixed thereto as a Control. The Control shotgun had the same bolt, slide and action bar assembly as the shotgun of Example 1. The following Procedure was carried out for the shotgun of Example 1 and the Control shotgun in turn, and the ejection distance of shotshells ejected from the shotgun of Example 1 and the Control shotgun are shown in Table 2.

Procedure: A pulley is attached to the trigger guard of the shotgun to be tested. The shotgun is locked between two bench vises (about 3 feet from the ground) on gravel covered ground that is even and substantially horizontal (not sloped). A 25 lb (11.3 kg) weight is attached to 550-lb paracord on one end thereof, and the other end of the paracord is run through the pulley attached to the trigger guard, and affixed to the forend of the action bar assembly of the shotgun. The length of the paracord is adjusted so that it is slack when the weight is placed on the base of the bench vise situated behind (to the rear of) the action bar assembly, but when dropped does not reach the ground. The attached weight is placed on the base of the bench vise situated to the rear of the action bar assembly. Then the shotgun is loaded with proving dummy rounds having 1⅞-oz shot weight.

Accordingly, when the trigger of the shotgun loaded with the dummy rounds is pressed toward the rear of the shotgun—that is, when the "firing" action of the shotgun is initiated—the hammer of the shotgun is caused to move forward, causing the weight to drop toward the ground. Dropping the weight causes the action bar to cycle rearward, engaging the ejector to eject the dummy shotshell which then falls to the ground.

After each ejection, the ejection distance of the shotshell is determined by measuring the distance between the ejected shotshell (at the approximate center of the shotshell length) and a point located on the bottom of the bench vise behind the action bar assembly. In each test, a shotgun is fired a total of three times, reloading between each firing and resetting the weight as described above; and the ejection distance is averaged for the three ejected shotshells. Each shotgun to be comparatively tested is mounted to the same base vise arrangement, without moving the base vises between firings or between tests carried out on different shotguns; and the same weight and paracord combination is used in each test.

TABLE 2

Ejection distance of shotshells ejected from the shotgun of Example 1 and the Control shotgun, measured in accordance with the Procedure.

| | Ejection distance, inches (meters) | |
|---|---|---|
| Test fire # | Example 1 shotgun | Control shotgun |
| 1 | 222 (5.64) | 98 (2.49) |
| 2 | 279 (7.09) | 120 (3.05) |
| 3 | 187 (4.75) | 106 (2.69) |
| Average | 229 (5.82) | 108 (2.74) |

The foregoing results demonstrate the robust operation of the ejector spring when situated in a cantilevered tongue-and-groove configuration.

The invention illustratively disclosed herein can be suitably practiced in the absence of any element which is not specifically disclosed herein. Additionally each and every embodiment of the invention, as described herein, is intended to be used either alone or in combination with any other embodiment described herein as well as modifications, equivalents, and alternatives thereof. In various embodiments, the invention suitably comprises, consists essentially of, or consists of the elements described herein and claimed according to the claims. It will be recognized that various modifications and changes may be made without following the example embodiments and applications illustrated and described herein, and without departing from the scope of the claims.

The invention claimed is:

1. A kit comprising an ejector spring, a base member, a first fastener, and a second fastener, wherein the ejector spring comprises first spring end, second spring end, first spring major side, second spring major side, a tongue engagement section proximal to the first spring end, a tongue curved section proximal to the tongue engagement section, and an ejector section extending from the tongue curved section to the spring second end;

the base comprises first base end, second base end, first base major side, second base major side, first and second fastener holes defined between first base major side and second base major side, a tongue engagement hole defined between first base major side and second base major side and positioned between first and second fastener holes, and a tongue engagement recess defined in second base major side and contiguous to the tongue engagement hole; wherein the tongue engagement hole and tongue engagement recess are adapted and configured to allow the spring tongue engagement section to extend slidably through the tongue engagement hole from first base major side toward second base major side to engage with the tongue engagement recess in flush configuration with respect to the second base major side;

the first fastener is designed and adapted to engage with the first fastener hole; and the second fastener is designed and adapted to engage with the second fastener hole.

2. The kit of claim 1 wherein the spring consists of spring steel.

3. The kit of claim 1 wherein the spring excludes holes defined therethrough.

4. The kit of claim 1 wherein the base is formed from 1018 cold rolled steel.

5. The kit of claim 1 wherein the first and second fasteners are screws, further wherein the first fastener hole is threaded in a mating configuration with respect to the first fastener and the second fastener hole is threaded in a mating configuration with respect to the second fastener.

6. The kit of claim 1 wherein the first and second fasteners are adapted to extend through the receiver of a shotgun to engage with the first and second fastener holes.

7. The kit of claim 1 wherein the base member further includes a rail portion disposed on first base major side and extending away therefrom.

8. The kit of claim 7 wherein the rail portion further includes a nose feature.

9. The kit of claim 7 wherein the rail portion further includes a riser.

10. The kit of claim 7 wherein the rail portion further includes a shoulder feature.

11. The kit of claim 1 wherein the base member further includes one or more steps defined on second base major side and extending from first base end to second base end.

* * * * *